United States Patent [19]

Yasujima et al.

[11] 4,338,145

[45] Jul. 6, 1982

[54] CHROME-TANTALUM ALLOY THIN FILM RESISTOR AND METHOD OF PRODUCING THE SAME

[75] Inventors: Nobuo Yasujima, Kawagoe; Natsuo Itokawa, Fujioka; Seiichiro Kobayashi, Yoshida, all of Japan

[73] Assignee: Taisei Kohki Co., Ltd., Saitama, Japan

[21] Appl. No.: 216,640

[22] Filed: Dec. 15, 1980

[30] Foreign Application Priority Data

Dec. 27, 1979 [JP] Japan ..... 54-172418

[51] Int. Cl.[3] ..... H01C 1/012; C22C 27/02; C22C 27/06

[52] U.S. Cl. ..... 148/133; 204/192 F; 427/124; 428/432; 148/422; 148/423

[58] Field of Search ..... 75/174, 176; 148/133; 204/192 F; 428/432, 433; 427/124, 126

[56] References Cited

U.S. PATENT DOCUMENTS

| | | | |
|---|---|---|---|
| 3,629,776 | 12/1971 | Watano | 204/192 F |
| 3,763,026 | 10/1973 | Cordes | 204/192 F |
| 3,847,658 | 11/1974 | Kumagai | 204/192 F |
| 3,874,922 | 4/1975 | Mickelsen | 204/192 F |
| 4,063,211 | 12/1977 | Yasujima et al. | 75/174 |
| 4,172,718 | 10/1979 | Menzel | 75/174 |

FOREIGN PATENT DOCUMENTS

| | | | |
|---|---|---|---|
| 828047 | 2/1960 | United Kingdom | 75/174 |

OTHER PUBLICATIONS

Oohashi et al., "Preparation of Tantalum-Titanium Alloy Thin Films by DC Glow-Discharge Sputtering" Electronics and Communications in Japan, vol. 55-C, No. 8, Aug. 1972, pp. 59-66.

Halaby et al., "The Materials of Thin-Film Devices", Electro-Technology, Sep. 1963, pp. 105-107.

Michalak, "Low Energy Sputtering of Resistive Films", Vacuum, vol. 17, No. 6, pp. 317-324.

*Primary Examiner*—Peter K. Skiff

*Attorney, Agent, or Firm*—Kenway & Jenney

[57] ABSTRACT

A chrome-tantalum thin film resistor having a chrome-tantalum alloy thin film containing 10 to 95 atomic % of chrome. By subjecting this chrome-tantalum alloy thin film to heat treatment at temperatures not higher than 900° C., a stable resistor can be obtained. Alternatively, by forming the chrome-tantalum alloy thin film on a substrate which is preheated at temperatures not higher than 900° C., the temperature coefficient of resistance of the resistor can be improved so that a stable resistor can be obtained.

9 Claims, 5 Drawing Figures

CHROME-TANTALUM ALLOY THIN FILM RESISTOR AND METHOD OF PRODUCING THE SAME

BACKGROUND OF THE INVENTION

The present invention relates to a highly stable thin film resistor comprising an alloy of tantalum and chrome, which has a low resistance and a small temperature coefficient of resistance, and to a method of producing the same.

With the recent rapid development of the electronics industry, requirements for the electronic characteristics of circuit elements have become very severe. Conventionally, nichrome type materials have been mainly used as the resistance materials for making thin film circuits and individual resistors. For the purpose of improving the stability in performance of the thin film circuits and the resistors, tantalum nitride thin film resistors have been developed and are used in practice. The specific resistance of the tantalum nitride thin film resistors is about 260 μΩ.cm and the sheet resistivities of the film resistors formed with a thickness for practical use are in the range of 50 to 200 Ω/□. However, the tantalum nitride thin film resistors are still poor in temperature characteristics and stability. Therefore, they cannot meet the present requirements for electric characteristics. Tantalum nitride forms an interstitial solid solution with nitrogen of small atomic radius, so that it has extremely high mechanical strength. However, tantalum nitride has a problem with respect to stability in electric characteristics at high temperatures. Furthermore, when the tantalum nitride thin film resistors are produced by a reactive sputtering method, it is required that slight amounts of active gases be introduced into a vacuum chamber, so that an extremely precise control technique is indispensable to that method.

SUMMARY OF THE INVENTION

It is therefore an object of the present invention to provide an extremely stable resistor comprising a substitutional solid solution of chrome and tantalum, which has a low resistance and a small temperature coefficient of resistance, and to provide a method of producing the resistor of the type described from which the above-described drawbacks in the prior art resistors have been successfully eliminated.

In order to attain the above-mentioned object, the resistor according to the present invention is constructed of a chrome-tantalum alloy thin film comprising 10 to 95 atomic percent of chrome in tantalum. According to the present invention, a resistor with an extremely low specific resistivity in comparison with that of any conventional thin film resistor can be easily obtained. Further, according to the present invention, by subjecting the resistor to a heat treatment at temperatures not higher than 900° C., the temperature coefficient of resistance can be decreased as desired over a wide temperature range and, at the same time, the stability of the resistor can be improved significantly. The same results can be obtained when a thin film layer is formed while heating the substrate of the resistor at temperatures not higher than 900° C., so that the abovementioned heat treatment can be omitted. In other words, the temperature coefficient of resistance can be adjusted by the heat treatment after the formation of the film or by application of heat during the formation of the film. At the same time, by that heat treatment of the resistor or application of heat to the substrate, the stability of the film resistor can be significantly improved so that it is superior to tantalum nitride. One of the most remarkable points about the resistor according to the present invention is that its resistance is determined by the ratio of the chrome area to the tantalum area in the target for the sputtering and by the thickness of the sputtered metallic layer and is little affected by other film formation conditions. Further, the characteristics of the resistor are stable during its repeated use. The adjustment of the gas pressure during the sputtering is to maintain the electrical discharging properly and such a delicate adjustment of the ratio of argon to nitrogen as in the case of tantalum nitride is not required. Thus, according to the present invention, various advantages over the prior art resistors can be obtained in the properties of the resistor and in the production thereof.

These and other objects of the invention will become apparent from the following description of embodiments thereof when taken together with the drawings.

DETAILED DESCRIPTION OF THE PREFERRED EMBODIMENTS

Figure 1:
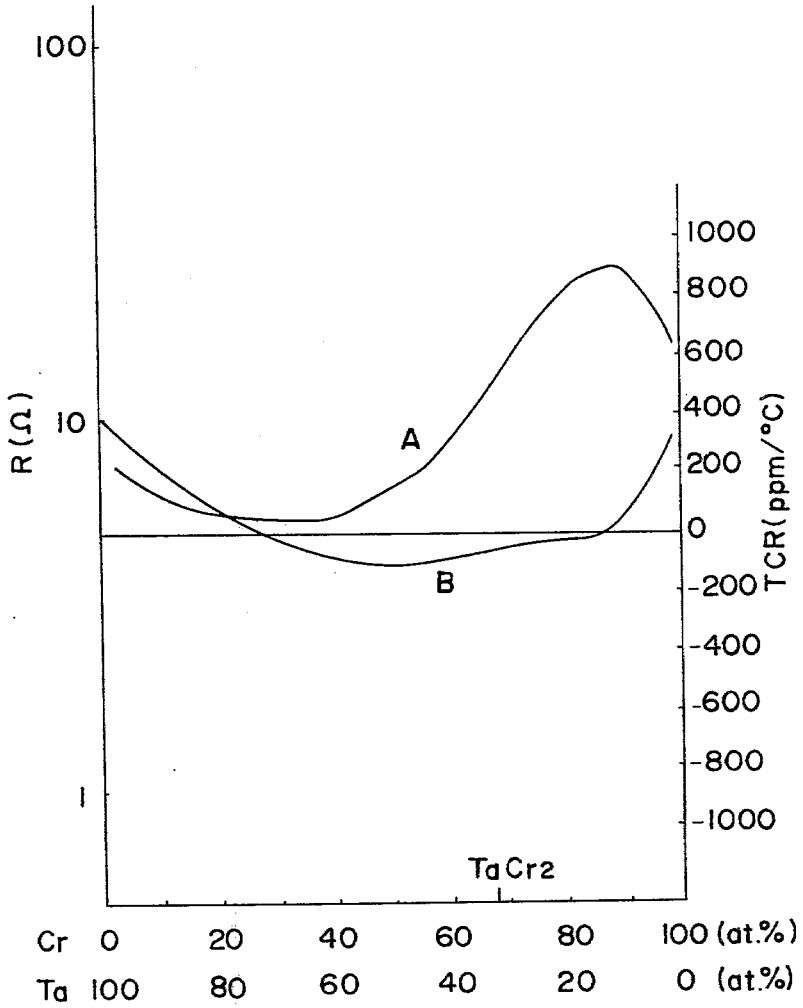
FIG. 1 is a graph showing the relationship between the resistance of a thin resistor according to the present invention and the content of chrome in the thin film resistor, and the relationship between the temperature coefficient of resistance of the resistor and the content of chrome in the resistor.

Referring to FIG. 1, there are shown the characteristics of chrome-tantalum alloy thin film resistors including 10 to 95 atomic % of chrome in tantalum according to the present invention. In particular, in the figure, there are shown the changes in resistance R(Ω) and temperature coefficient of resistance TCR (ppm/° C.) in accordance with the changes in the amounts (atomic %) of chrome Cr and tantalum Ta contained in the chrome-tantalum alloy thin film of the resistors. Curve A shows the resistance R, while curve B shows the temperature coefficient of resistance TCR.

The sample employed is a piece of forsterite which is 3 mm in diameter and 9 mm in length, on which chrome and tantalum are deposited to a thickness of 6,000 Å and to the opposite ends of which are attached 1.5 mm cap terminals.

As can be seen from the graph in FIG. 1, the resistance R gradually decreases as the amount of chrome increases from 0% to 30%, increases sharply thereafter up to approximately 90%, and suddenly decreases when the amount of chrome reaches 90%. On the other hand, the temperature coefficient of resistance TCR gradually decreases as the content of chrome increases from 0%, begins to increase when the content of chrome reaches 50%, continues to gradually increase as the amount of chrome increases from 50% to 90%, and rapidly increases thereafter.

As can be seen from the above, the resistance R of the thin film resistor according to the present invention is as low as 5 to 20Ω. The temperature coefficient of resistance of the thin film resistor is nearly zero over a wide range wherein the content of chrome ranges from 10 to 95 atomic %.

When the content of chrome is less than 10 atomic % or more than 95 atomic %, the temperature coefficient of resistance is greatly shifted in the positive direction and such a shift is undesirable. In connection with the stability of the thin film resistor which will be mentioned later, it is preferable that the content of chrome range from 40 atomic % to 80 atomic % which covers 67 atomic % which is equivalent to $TaCr_2$.

A method of producing a thin film resistor according to the present invention will now be explained.

The conditions for making a sample are attained by evacuating a belljar to a vacuum degree of $3\times10^{-7}$ Torr., and introducing high purity argon therein to a pressure of $10\sim20\times10^{-3}$ Torr. Under these conditions diode sputtering is effected on forsterite with a cathode voltage of −5.7 to −6.5 KV, a current density of 0.2 to 0.5 mA/cm$^2$, and a film forming speed of 50 to 150 Å/min.

The composition of the film resistor layer of the thin film resistor can be changed by changing the ratio of the area of chrome to that of tantalum in the cathode which comprises a chrome plate with a tantalum plate mounted thereon.

Figure 2:
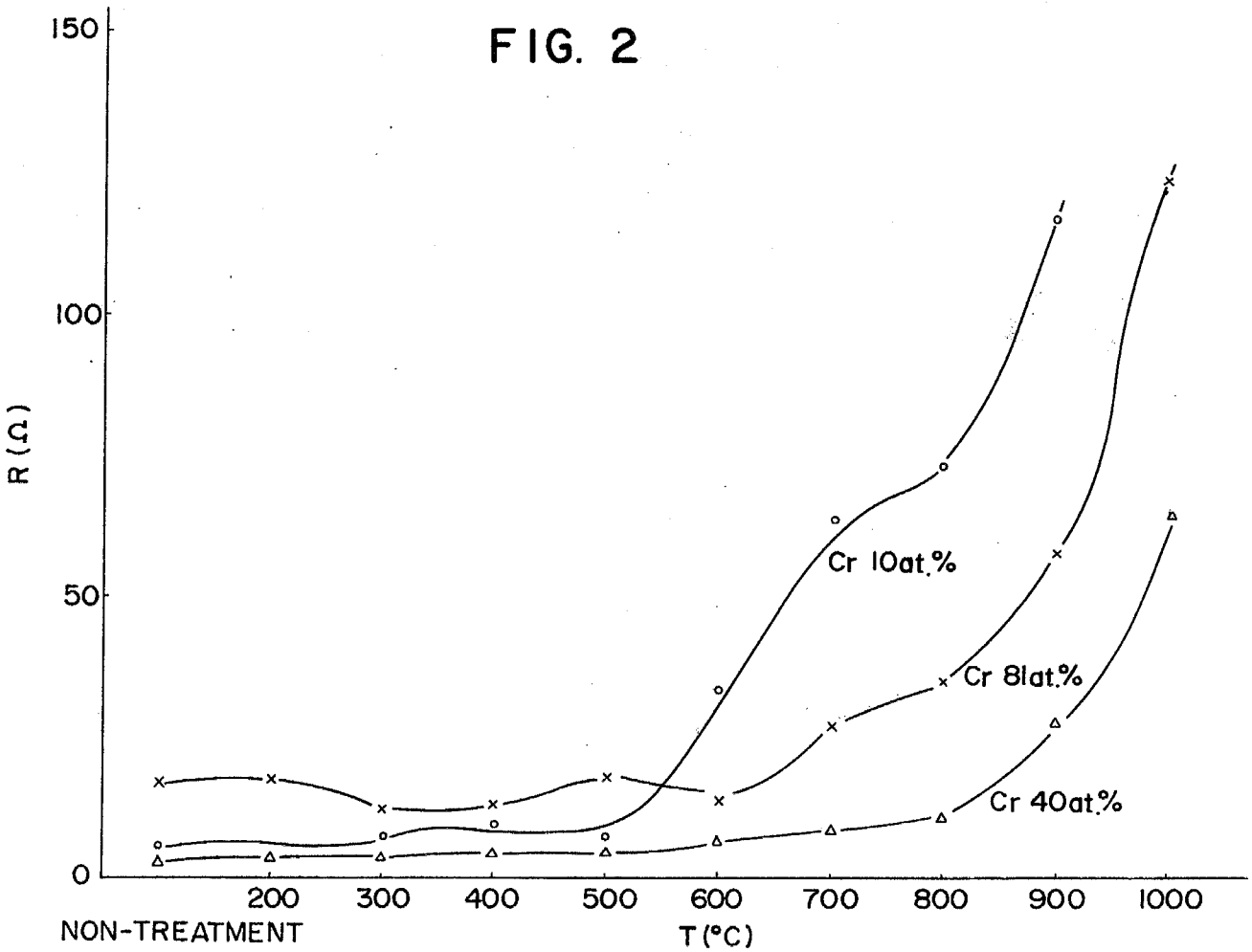
FIG. 2 is a graph showing the changes in the resistance of the thin film resistors with different contents of chrome, which changes are caused by heat treatment of the thin film resistors.

Referring to FIG. 2, the samples which were prepared in the same manner as the samples in FIG. 1, with different chrome contents of 10, 40 and 81 atomic %, were subjected to heat treatment in the open air at a temperature elevation rate of 15° C./min, and changes in resistance of each of the resistors during the course of the temperature elevation, are recorded in the figure. As can be seen from FIG. 2, the resistances of those samples not changed so much at the temperatures ranging from 200° to 900° C. by the changes in the content of chrome or heat treatment temperature T. However, there is a tendency for the resistance to increase as the heat treatment temperature increases. Probably this is because the effective thickness of the film resistor decreases by the formation of an oxidized film on the surface of the resistor as the heat treatment temperature increases.

When the heat treatment temperature T exceeds 900° C., the oxidation of the film resistor proceeds significantly and the resistance of the resistor increases rapidly. That is not desirable. When the heat treatment temperature is below 200° C., the oxidized film is barely formed and the resistor is far better than the nichrome type resistors, although its humidity resistance properties are inferior to those of the nichrome type resistors.

Figure 3:
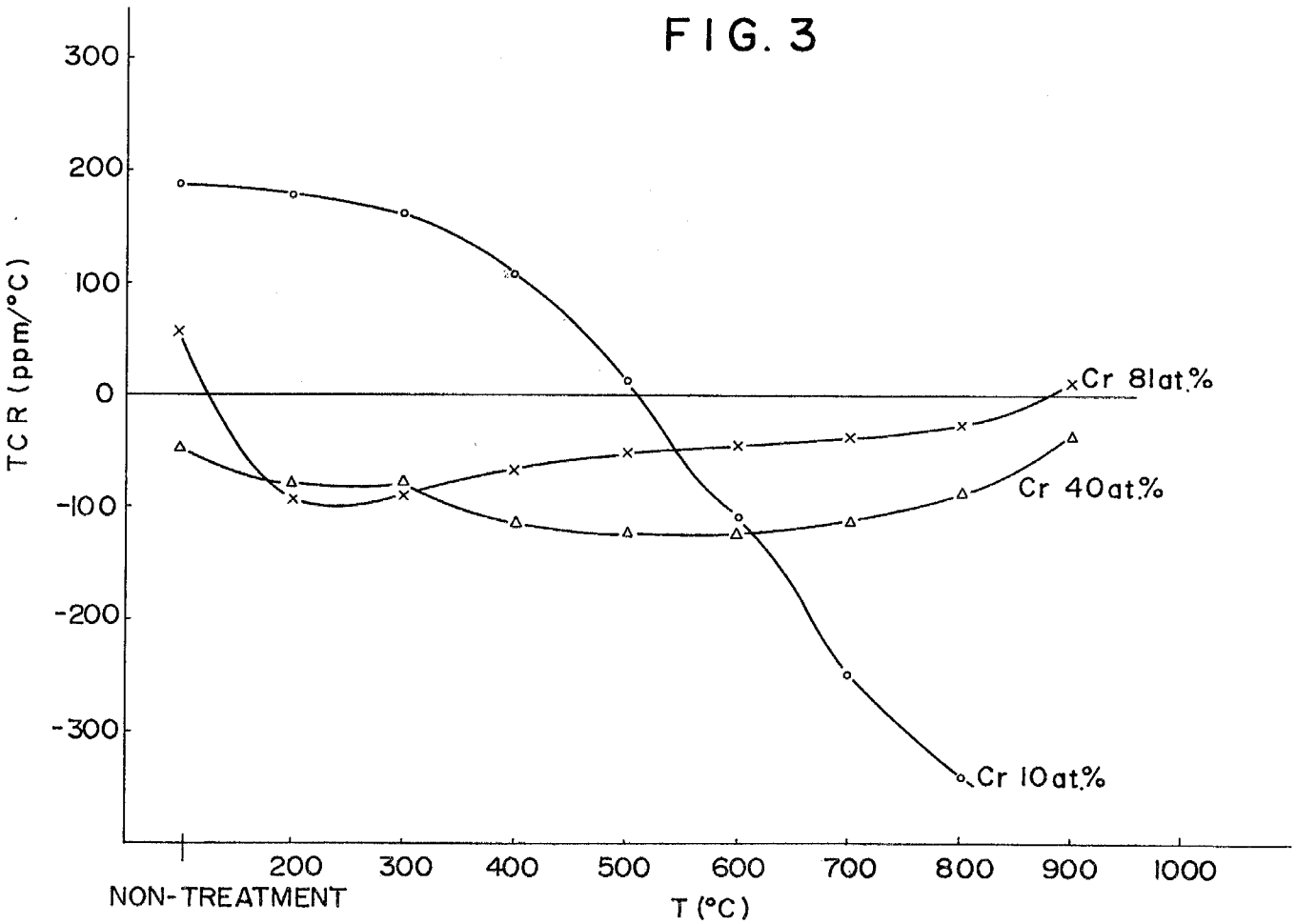
FIG. 3 is a graph showing the changes in the temperature coefficient of the thin film resistors with different contents of chrome, which changes are caused by heat treatment of the thin film resistors.

Referring to FIG. 3, the samples which were prepared in the same manner as the samples in FIG. 2 were subjected to heat treatment in the open air at a temperature elevation rate of 15° C. min., and changes in the temperature coefficient of resistance TCR of each of the resistors in the course of the elevation of temperature are recorded in the figure. As shown in the figure, the temperature coefficient of resistance TCR of each of the resistors is adjustable from a positive or negative value to the desired small value near zero, depending upon the content of chrome, by the heat treatment at temperatures ranging from 200° C. to 900° C., Thus, the temperature coefficient of resistance is changed by the heat treatment. Probably, this is because the properties of the resistors are changed by the growth of crystals or by some delicate changes in the grain boundary precipitation layer of the resistor in the course of the heat treatment.

Figure 4:
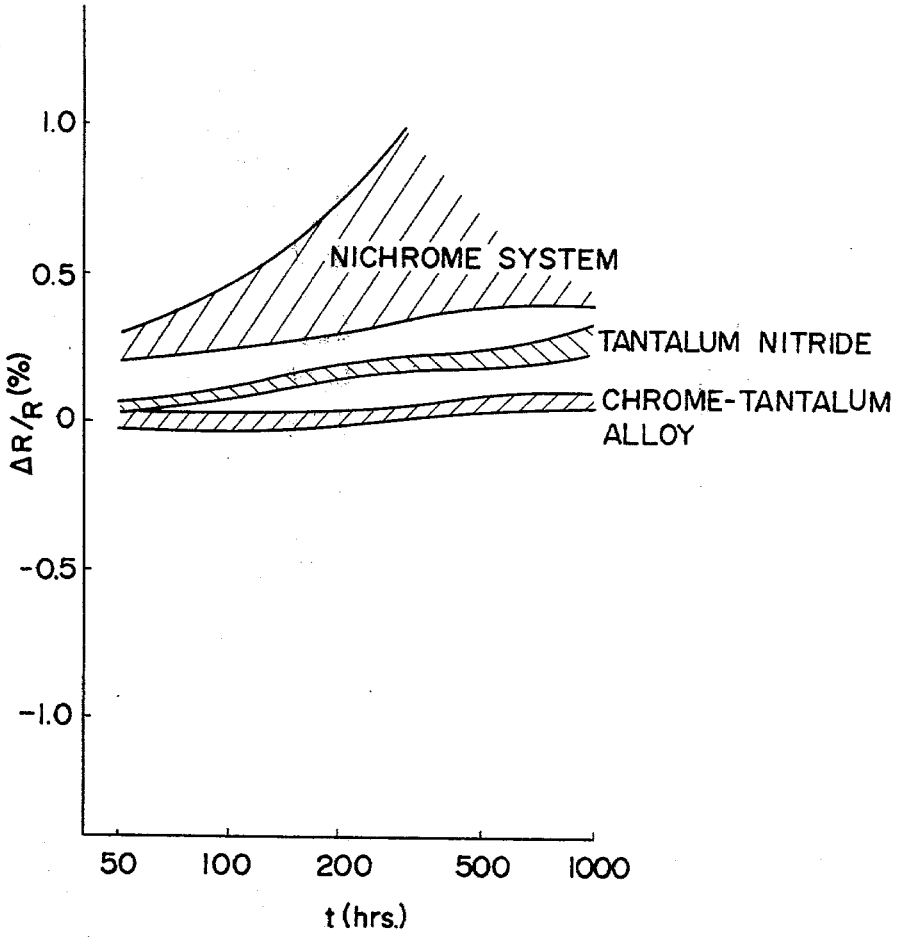
FIG. 4 and FIG. 5 are graphs showing the rate of change in resistance of the film resistors containing 67 atomic % of chrome in a load life test and a humidity resistance load life test in comparison with other alloy thin film resistors.

Referring to FIG. 4, there are shown the results of a load life test of a resistor containing 67 atomic % of chrome ($TaCr_2$) which was subjected to heat treatment at 500° C. in the open air, together with the load life test results of a nichrome type thin film resistor (in the figure, referred to as the nichrome system) and of a tantalum nitride thin film resistor. The tests were conducted under the conditions that the temperature in the chamber was 125°±2° C., ¼ W 50% rated load was applied to the resistor, and the electric current was applied to the resistor intermittently, i.e., with 1.5 hrs. on for each 0.5 hrs. off.

Referring to FIG. 4, the data in the load life test are plotted, with test time t (hrs) as abscissa and resistance change rate ΔR/R (%) as ordinate. As can be seen from the figure, the resistance change rate ΔR/R of the thin film resistor according to the present invention in this load life test is sufficiently small in comparison with the resistance change rate of the nichrome type thin film resistor, and is smaller than that of the tantalum nitride thin film resistor which has been conventionally considered to be the most stable in operation.

Figure 5:
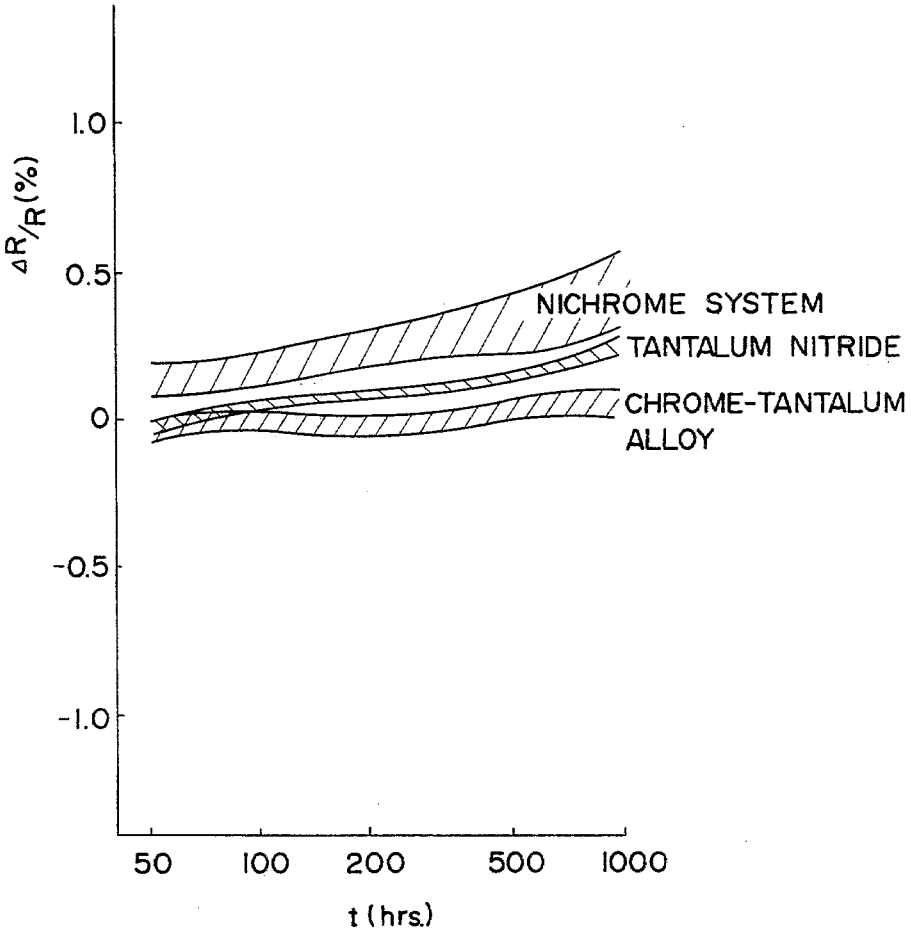

Referring to FIG. 5, there are shown the results of a humidity resistance load life test of a resistor which was prepared in the same manner as the sample employed in the load life test shown in FIG. 4, together with the humidity resistance load life tests of a nichrome type thin film resistor (in the figure, referred to as the nichrome system) and of a tantalum nitride thin film resistor. Those tests were conducted under the conditions that the temperature in the chamber was 40°±2° C., the humidity (relative humidity) was 90 to 95%, ½ W 100% rated load was applied to the resistor, and the electric current was applied to the resistor intermittently, i.e., with 1.5 hrs. on for each 0.5 hrs. off.

In FIG. 5, the data in the humidity resistance load life tests are plotted, with test time t (hours) as abscissa and resistance change rate ΔR/R(%) as ordinate. As can be seen from the figure, the resistance change rate ΔR/R(%) of the thin film resistor according to the present invention in this humidity resistance load life test is sufficiently small in comparison with the resistance change rate of the nichrome type thin film resistor, and is smaller than that of the tantalum nitride thin film resistor which has been conventionally considered to be the most stable in operation.

The reason the resistor according to the present invention has such a high resistance to the humidity is probably that a complete oxidized film layer is formed on the Cr-Ta surface of the resistor during the heat treatment in the open air.

In the above-mentioned accelerated life tests, the substrate of each thin film resistor is made of forsterite porcelain, which is by no means inferior to alumina porcelain which is considered to have excellent characteristics for use as the substrate in thin film resistor elements, and is not inferior to glazed alumina porcelain which is employed in other resistors. The forsterite porcelain is inexpensive and easy to cut to an appropriate size for each resistor, so that the production cost of the resistors can be reduced considerably in comparison with conventional resistors.

Another embodiment of a chrome-tantalum thin film resistor according to the present invention will now be explained. In this embodiment, a substrate is heated at temperatures ranging from 200° to 900° C. and chrome and tantalum are sputtered onto the substrate in the same manner as in the previously mentioned embodiment, so that a tantalum-chrome alloy thin film layer containing 10 to 95 atomic % of chrome is formed on the substrate. In this embodiment, the temperature coefficient of resistance TCR can be changed by changing the temperature of the substrate when it is heated and the heat treatment process after the sputtering can be advantageously omitted. Further in this case, the resistor according to the present invention is superior in electric characteristics to the nichrome type resistors even if the oxided film layer is intentionally omitted from the resistor.

Further, in the chrome-tantalum thin film resistors according to the present invention, no substantial changes in the electric characteristics of the resistors can be observed even if up to 12% of certain impurities, such as nickel, cobalt and iron, are contained.

According to the present invention, the resistors are formed with a chrome-tantalum alloy thin film containing 10 to 95 atomic % of chrome in tantalum, whereby the resistors with extremely low specific resistivities in comparison with those of conventional thin film resistors can be easily obtained. Further, when the resistors according to the present invention are subjected to heat treatment at temperatures not higher than 900° C., the resistors are improved with respect to their temperature coefficient of resistance, so that the temperature coefficient of resistance can be set at a desired small value and, at the same time, the stability of the thin film resistors can be significantly improved. Further, when the sputtering is performed while heating the substrate at temperatures not higher than 900° C., the same effect as mentioned above can be obtained even if the above-mentioned heat treatment process is omitted.

Thus, there is provided in accordance with the invention a chrome-tantalum alloy thin film resistor which has the advantages discussed above. The embodiments described above are intended to be merely exemplary and those skilled in the art will be able to make variations and modifications in them without departing from the spirit and scope of the invention. All such modifications and variations are contemplated as falling within the scope of the claims.

What is claimed is:

1. A chrome-tantalum thin film resistor comprising a substrate and a chrome-tantalum alloy thin film on said substrate, said alloy consisting essentially of 10 to 95 atomic % of chrome and the balance being tantalum, said thin film having a temperature coefficient of resistance near zero.

2. A chrome-tantalum thin film resistor comprising a substrate and a chrome-tantalum alloy thin film consisting essentially of 10 to 95 atomic % of chrome and the balance being tantalum formed on said substrate preheated heated to a temperature selected to provide a temperature coefficient of resistance of the thin film near zero, but not higher than 900° C.

3. A chrome-tantalum thin film resistor comprising a substrate and a chrome-tantalum alloy thin film on said substrate, said alloy consisting essentially of 10 to 95 atomic % of chrome and the balance being tantalum, said chrome-tantalum alloy thin film having been subjected to heat treatment at a temperature selected to provide a temperature coefficient of resistance near zero, but not higher than 900° C.

4. A method of producing a chrome-tantalum thin film resistor comprising the steps of forming a chrome-tantalum alloy thin film consisting essentially of 10 to 95 atomic % of chrome and the balance being tantalum on a substrate and heating said chrome-tantalum alloy thin film on said substrate to a temperature selected to provide a temperature coefficient of resistance near zero, but not higher than 900° C.

5. A method of producing a chrome-tantalum thin film resistor comprising the steps of heating a substrate to a temperature not higher than 900° C. and forming a chrome-tantalum alloy thin film consisting essentially of 10 to 95 atomic % of chrome and the balance being tantalum on said heated substrate, said temperature being selected to provide a temperature coefficient of resistance of said thin film near zero.

6. The method of claim 5 wherein said forming is by cathode sputtering.

7. The method of claim 4 or 5 wherein said temperature is at least 200° C.

8. The resistor of claims 2, 1 or 3 wherein said substrate is selected from the group consisting of forsterite porcelain, alumina porcelain and glazed alumina porcelain.

9. The method of claims 4, 5 or 6 wherein said substrate is selected from the group consisting of forsterite porcelain, alumina porcelain and glazed alumina porcelain.

* * * * *

UNITED STATES PATENT AND TRADEMARK OFFICE

CERTIFICATE OF CORRECTION

PATENT NO. : 4,338,145

DATED : July 6, 1982

INVENTOR(S) : NOBUO YASUJIMA et al

It is certified that error appears in the above—identified patent and that said Letters Patent is hereby corrected as shown below:

IN THE SPECIFICATION:

Column 1, line 63, "abovemen" should read ---above-men---.

Column 3, line 43, prior to "not" insert -- is -- and line 63, "15° C." should read ---15°/C.---.

Column 4, line 3, delete the comma "," prior to "Thus"; line 18, delete "°" after "125"; and line 40, delete "°" after "40".

IN THE CLAIMS:

Column 6, claim 2, line 12, delete "heated".

Signed and Sealed this

*Seventh* Day of *December 1982*

[SEAL]

*Attest:*

GERALD J. MOSSINGHOFF

*Attesting Officer*

*Commissioner of Patents and Trademarks*